US005137197A

United States Patent [19]

Bauer

[11] Patent Number: 5,137,197

[45] Date of Patent: Aug. 11, 1992

[54] DRIVING TOOL FOR FASTENERS INCLUDING LOCKING MEANS

[76] Inventor: Joachim Bauer, Hugo-Klemm-Strasse 8, 2100 Hamburg 90, Fed. Rep. of Germany

[21] Appl. No.: 613,304

[22] Filed: Nov. 15, 1990

[30] Foreign Application Priority Data

Dec. 19, 1989 [DE] Fed. Rep. of Germany ... 8914926[U]

[51] Int. Cl.[5] ..... B25C 1/04

[52] U.S. Cl. ..... 227/8; 227/130

[58] Field of Search ..... 227/8, 130

[56] References Cited

U.S. PATENT DOCUMENTS

| | | | |
|---|---|---|---|
| 3,011,169 | 12/1961 | Cast et al. | 227/8 |
| 3,784,077 | 1/1974 | Burke, Jr. et al. | 227/8 |
| 3,948,426 | 4/1976 | La Pointe | 227/8 |
| 4,597,517 | 7/1986 | Wagdy | 227/8 |
| 4,629,106 | 12/1986 | Howard et al. | 227/8 |

FOREIGN PATENT DOCUMENTS

| | | |
|---|---|---|
| 3021884 | 6/1980 | Fed. Rep. of Germany . |
| 3703753A1 | 2/1987 | Fed. Rep. of Germany . |
| 8810753.1 | 8/1988 | Fed. Rep. of Germany . |

*Primary Examiner*—Frank T. Yost
*Assistant Examiner*—Rinaldi Rada
*Attorney, Agent, or Firm*—Kinney & Lange

[57] ABSTRACT

A driving tool for fasteners includes a drive unit having a drive-in pusher for driving-in the fasteners through a mouth tool. The driving tool is provided with a trigger lever mounted for pivotal movements between rest and trigger positions for actuating an actuating member of the drive unit. Furthermore, the driving tool includes a sensor responsive to the driving tool being placed upon a workpiece and mounted for movements relative to the mouthpiece between rest and operative positions. The trigger lever is biased into its rest position wherein it extends beyond the mouth tool. The sensor and the trigger lever include abutment portions cooperating to prevent pivotal movements of the trigger lever from its rest position into its trigger position when the sensor is in its rest position, and to allow for pivotal movements of the trigger lever from its rest position into its trigger position when the sensor is in its upward operative position.

9 Claims, 3 Drawing Sheets

DRIVING TOOL FOR FASTENERS INCLUDING LOCKING MEANS

BACKGROUND OF THE INVENTION

The present invention relates to a driving tool for fasteners including locking means.

German Petty Patent 88 10 753 discloses a driving tool including locking means, wherein a trigger lever has a longitudinally extending recess opening towards an actuating member so that the actuating member may not be readily actuated by the trigger lever. Said recess receives a movably mounted slide member which is operatively connected to a sensor. In response to actuation of the sensor the slide is displaced within the trigger lever so as to be located below said actuating member. When the actuating member is in this position, actuation of the trigger lever results in a displacement of the actuating member. Furthermore the operative connection between the sensor and the slide member is such that the trigger member even if the sensor has been placed upon a workpiece may be returned to its rest position so as to be actuated for triggering a further drive-in operation. Such means for individual triggering is provided in relatively big driving tools or in driving tools for fasteners of substantial length (e.g. 130 mm). Actuation of the trigger lever triggers only a single drive-in operation as opposed to driving tools of the repetition type wherein driving-in of fasteners occurs sequentially at a constant frequency as long as the trigger lever remains actuated. When the sensor is returned to its rest position with the trigger lever having been actuated, the sensor cannot be lifted again because the slide member will abut the actuating member. This is why the operator will have to release the trigger lever in order to retrigger a drive-in operation.

U.S. Pat. No. 4,629,106 discloses a driving tool including locking means, wherein the trigger lever receives a resiliently biased actuating lever pivotally mounted to co-operate with a latch lever also pivotally mounted within the trigger lever, with the latch lever being actuated by the sensor. In this driving tool when the sensor has been actuated individual triggering is not possible without causing the sensor to return to its rest position.

German patent application 30 21 884 discloses a driving tool including a sensor having a resilient telescopic section arranged to cooperate with a lever pivotally mounted in the trigger lever so that said lever remains in its rest position if the trigger lever is actuated first and the sensor is actuated thereafter. Triggering of the drive-in operation, accordingly, may be achieved only in a reverse sequence. Furthermore, in this driving tool individual triggering is possible by means of the trigger lever even when the sensor has been actuated. If the sensor is moved to its rest position with the trigger lever having been actuated, triggering of a drive-in operation by placing the sensor upon the workpiece and releasing and reactuating the trigger lever is not possible.

German patent specification 23 11 147 discloses a driving tool including a uniquely shaped lever pivotally mounted on a trigger member. This lever is caused to pivot by the sensor when the sensor is moved into its operative position. A pin is connected to the hollow trigger member and is arranged to actuate said lever only when said lever had been pivoted by the sensor first. A reverse sequence of operation is not possible. In this driving tool sequential individual triggering operations are possible when the sensor has been actuated. If the sensor when the trigger lever has been actuated is moved to a position close to its rest position, further individual triggering in a reverse sequence of operation is no longer possible.

SUMMARY OF THE INVENTION

It is a primary object of the present invention to provide a driving tool including locking means adapted to prevent an operative condition wherein the driving tool may be triggered by the sensor when the trigger lever has been actuated, however to enable an operative condition wherein a plurality of drive-in operations may be triggered by the trigger lever when the drive-in tool has been placed upon a workpiece. Furthermore, the driving tool of the invention is intended to allow for an operative condition wherein individual triggering is enabled by releasing and reactuating of the trigger lever when the sensor temporarily was not in contact with the workpiece while the trigger lever remained in its actuated position.

In the driving tool of the present invention the sensor and the trigger lever are arranged to cooperate by means of abutment portions. If both members are in their rest positions, the abutment portions prevent pivotal movements of the trigger lever and accordingly actuation of the actuating member as long as the sensor is in its rest position. Inadvertent driving operations which could hurt the operator or other persons are positively prevented thereby. Furthermore the sensor and the trigger lever are arranged to co-act by limiting portions which prevent return movements of the sensor to its rest position as long as the trigger lever is maintained in its actuating position. Relatively big driving tools generally are of a structure such that a reaction force resulting from the drive-in operation can be used by the operator to draw or push the driving tool to its next drive-in position without the necessity of generating a force for lifting the driving tool. If the operator retains the trigger lever in its operated position, the operator may use this reaction force for moving the driving tool to the next drive-in position. Furthermore he will be able to trigger a single drive-in operation thereafter. However, this is possible only when the sensor has been placed upon the workpiece. If the trigger lever has been released before, the sensor moves to its rest position and prevents triggering by means of the trigger lever. In the tool of the present invention cooperation between the trigger lever and the sensor is extremely simple. An inter-linkage or co-acting levers or the like are not necessary. All that is necessary is to shape the cooperating portions of the trigger lever and sensor so that they perform the above function.

Preferably the abutment portions and the limiting portions are the same portions of the trigger lever and sensor, respectively. The trigger lever may include a nose portion or the like which engages an abutment portion of the sensor when the latter is in its rest position. If, however, the sensor has been actuated, the trigger lever may be pivoted, with the nose portion moving into a recess of the sensor. The same nose portion can be used to prevent a return of the sensor into its rest position when the trigger lever remains in its actuated condition.

Preferably the sensor and said trigger lever include second abutment portions cooperating to prevent movements of said sensor from its rest position when said first abutment portion of the trigger lever has engaged said first abutment portion of the sensor due to a partial pivoting movement of the trigger lever. Accordingly the trigger lever may be pivoted to actuate the actuating member only when it had been in its rest position before and the sensor had been moved into its operative position.

Preferably the trigger lever is biased into its rest position by spring means. This allows the trigger lever automatically to move to its rest position in an overhead reverse position of the driving tool when the operator has released the trigger lever.

Preferably the sensor is also biased into its rest position. Since many of the driving tools are pneumatically operated, it is proposed to provide a piston acting upon the sensor, with an effective surface of the piston being subjected to the pressure of a pressure fluid source. Such biasing of the sensor is extremely reliable whereas helical springs or the like may become inoperative by failure. As a result thereof the locking means would change their operation in that they would act like a "contact trigger" causing even injuries of the operator.

The invention will be further described, by way of example, with reference to the accompanying drawings.

DETAILED DESCRIPTION OF THE PREFERRED EMBODIMENTS

Figure 1:
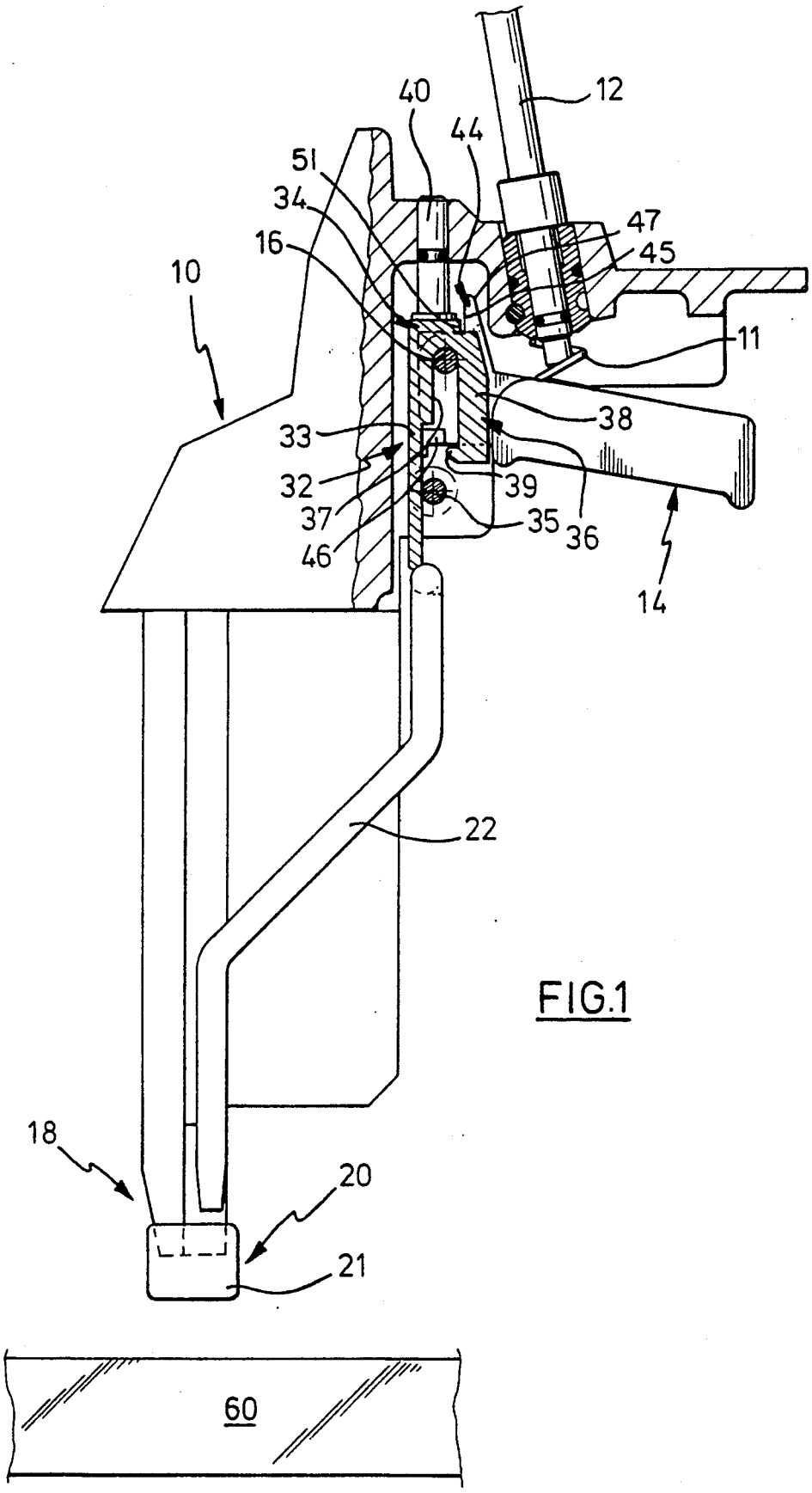
FIG. 1 is a side-elevation, partially in section, of the lower area of a driving tool of the present invention in a non-actuated condition.
Figure 2:
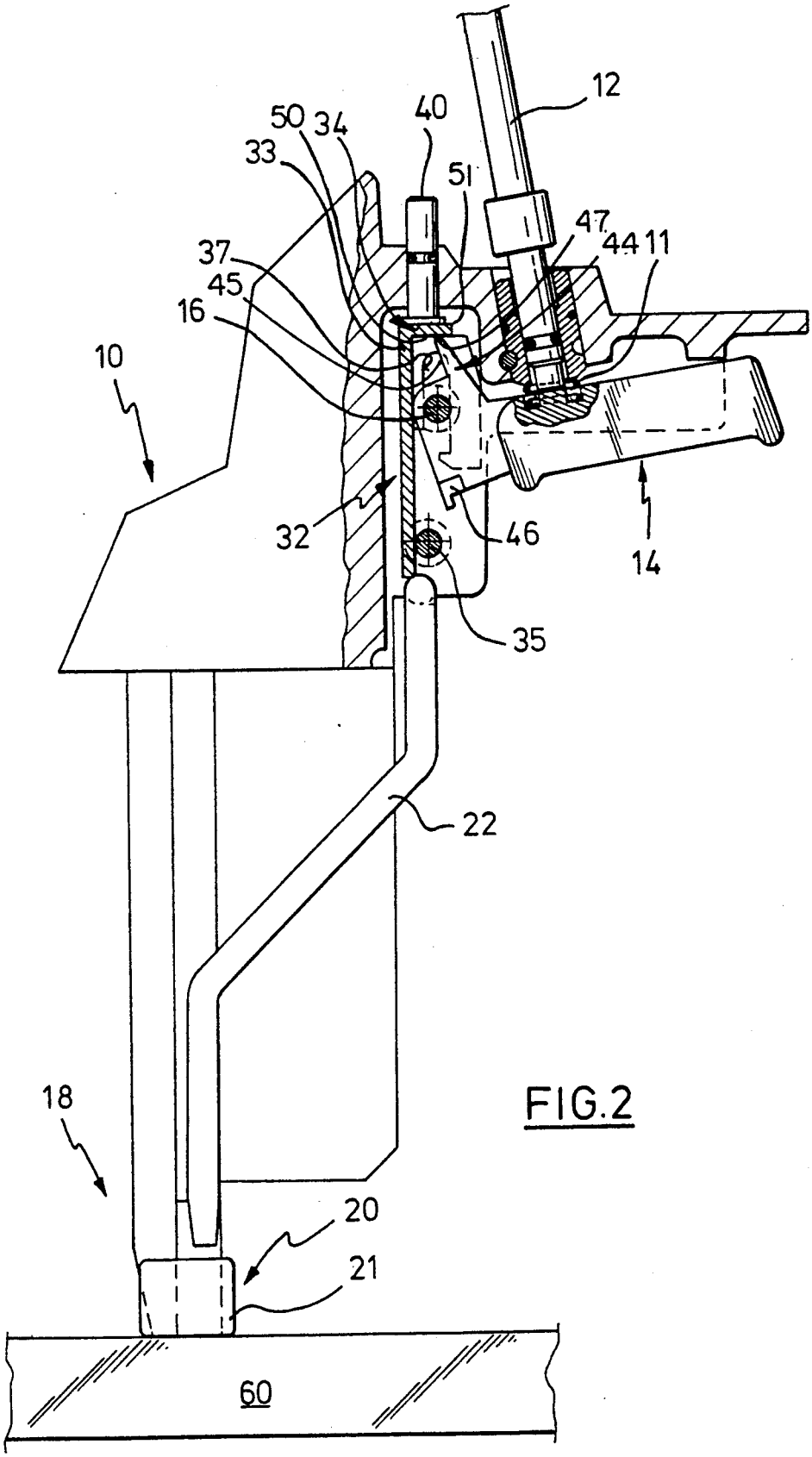
FIG. 2 is a view similar to FIG. 1, however in another plane of section and in a condition where the sensor and trigger lever have been actuated.
Figure 3:
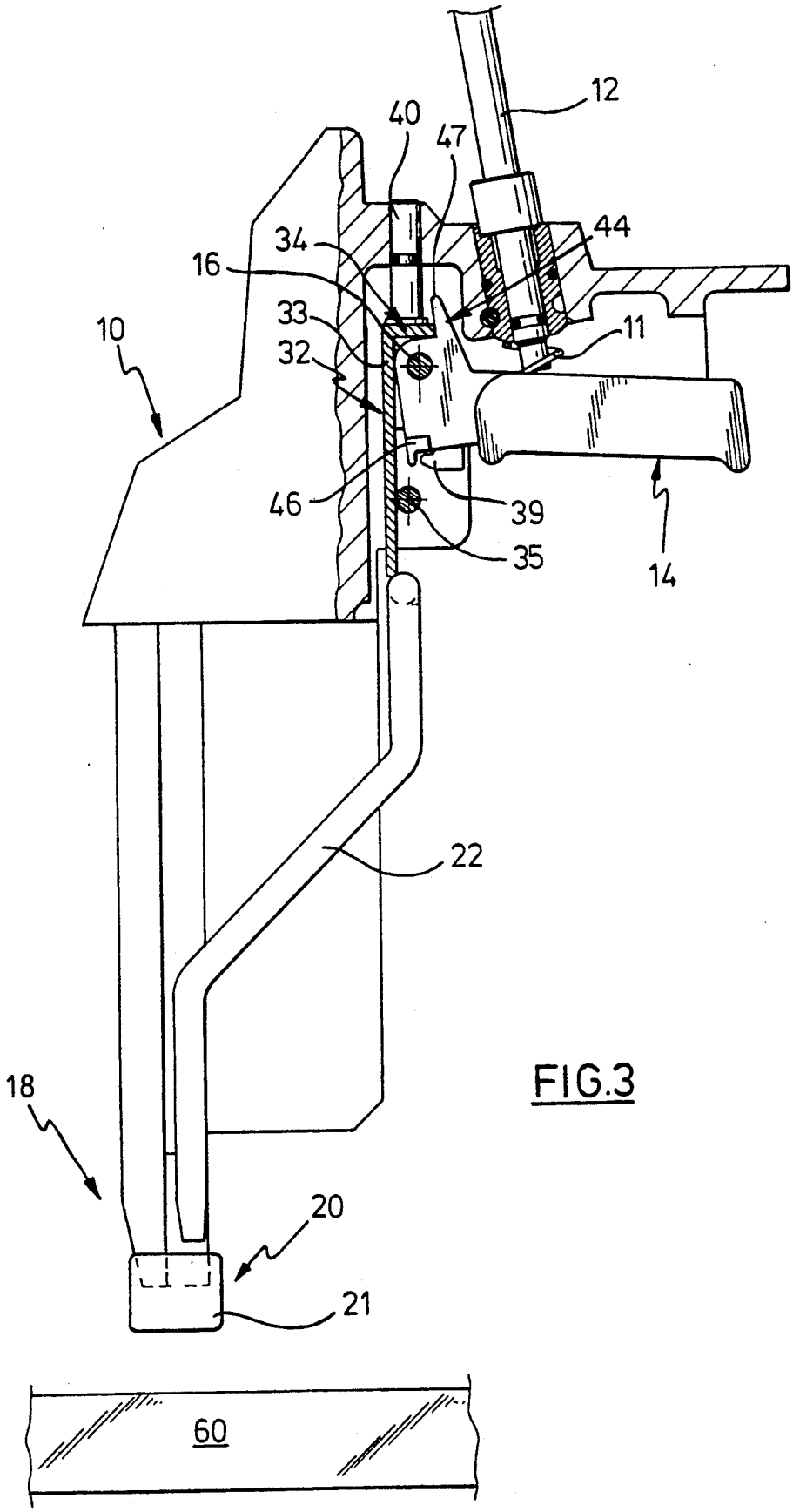
FIG. 3 is a view similar to FIG. 2, however in a condition where the sensor has not been actuated and the trigger has been partially actuated.

In FIGS. 1 to 3 a driving tool 10 is shown in a schematic manner. The driving tool 10 is a pneumatically operated nail driver. Such a pneumatically operated nail driver generally includes a trigger valve of which the drawings show only a valve rod 12. Below valve rod 12 there is a trigger lever 14 pivotally mounted by means of a pin 16. Trigger lever 14 is biased into a rest position by a pressure spring 11 which is supported on a guide of valve rod 12. As it is shown in FIG. 2, the opposite end of spring 11 is received in an angular groove of trigger lever 14.

At the bottom of driving tool 10 there is a mouth tool 18 including a drive-in channel for fasteners. The fasteners are driven through the drive-in channel by a drive-in pusher (not shown) which is operatively connected to a pneumatically actuated piston. A sensor 20 is associated with mouth tool 18. Sensor 20 comprises a section 21 adapted to be placed upon a workpiece 60, a Z-shaped rod section 22 connected to section 21, and a slide section 32 connected to the upper end of rod section 22. The upper and lower portions of rod section 22 are parallel to the drive-in channel. Slide section 32 includes a first flat portion 33 extending parallel to the drive-in channel and a second flat portion 34 extending transversely from the upper end of portion 33. Portion 33 has its side facing trigger lever 14 engage a transversely extending pin 35 forming a guide. Portions 33, 34 are connected to inverse U-shaped portions 36 in parallel spaced relationship so as to provide downwardly opening slits 37, through which pivot pin 16 extends. Accordingly pivot pin 16 also forms a guide for the upper part of sensor 20. As shown in the drawings legs 38 of sections 36 facing trigger lever 14 include an inwardly directed projection 39. A piston 40 engages portion 34, which piston is sealingly guided in a bore of the casing of the driving tool. The upper effective surface of piston 40 is subjected to the pressure of a pressure fluid source (not shown) so that piston 40 continuously biases sensor 20 in a downward direction.

The structure of trigger lever 14 in the area of slide section 32 is shown more clearly in FIGS. 2 and 3. It includes a nose portion 44 projecting upwardly above pivot pin 16. The nose portion 44 further includes a first abutment portion 45 and a first limiting portion 47. The first abutment portion 45 of nose portion 44 is shaped and arranged so as to engage a second abutment portion 51 of portion 34 when trigger lever 14 is pivoted and sensor 20 has not been actuated; as a result thereof trigger lever 14 cannot actuate valve rod 12. If, however, sensor 20 has been raised (FIG. 2), nose portion 44 may be accommodated by the space defined by portions 33, 34 and 36 so as to enable actuation of valve rod 12 by trigger lever 14 (FIG. 2).

Below pilot pin 16 there is a laterally extending a fourth abutment portion 46 which is arranged to co-act with projection or third abutment portion 39 so that projection 39 is not able to pass by the fourth abutment portion 46 when sensor 20 is intended to be moved upwardly. This is the case when trigger lever 14 has been partially actuated so that the first abutment portion 45 of nose portion 44 engages a second abutment portion 51 of portion 34.

Operation of the above driving tool is as follows. In FIG. 1 driving tool 10 is in its inoperative condition. Sensor 20 extends beyond the lower end of mouth tool 18. Trigger lever 14 is also in its rest position, i.e. it has not been actuated. For operation of the driving tool 10 it is placed upon work piece 60 so as to displace sensor 20 upwardly (FIG. 2). Slide section 32 is also moved upwardly against the force acting upon piston 49. If trigger lever 14 is not actuated, valve rod 12 will be raised to trigger operation of the driving tool. If trigger lever 14 is returned into the position shown in FIG. 1, sensor 20 is retained by workpiece 60 in its operative position so that trigger lever 14 may be repeatedly actuated to trigger further drive-in operations.

If driving tool 10 is lifted from workpiece 60 e.g. due to a reaction force, trigger lever 14 remains in its actuated position; slide section 32 cannot move downwards because it is stopped by the engagement of the first limiting portion 47 of nose portion 44 with the second limiting portion 50 of portion 34 (FIG. 2). If the driving tool will be again placed upon workpiece 60, a further drive-in operation may be triggered by releasing and reactuating of trigger lever 14.

If, however, trigger lever 14 is released while the driving tool is in a raised position, slide section 32 and the rest of sensor 20 move downwards. A reactuation of trigger lever 14 does not result in triggering because pivotal movement of trigger lever 14 about pivot pin 16 is interrupted by the first abutment portion 45 of nose portion 44 engaging the second abutment portion 51 of portion 34 (FIG. 3). In this position displacement of sensor 20 is not possible because abutment the fourth portion 46 abuts projection 39 preventing further upward movements of sensor 20. Only when trigger lever 14 has been completely released, sensor 20 when placed upon workpiece 60 may be moved to the position shown in FIG. 2, which allows triggering a driving operation by actuation of trigger lever 14.

Pressure spring 11 ensures that trigger lever 14 moves into its rest position when the driving tool is used in an inverted position.

What is claimed is:

1. A driving tool for fasteners, said driving tool comprising: actuating means suited for connection with an energization source for actuating a drive means, said drive means being capable of initiating a drive-in pusher so as to drive in fasteners from a mouth tool; a trigger lever pivotally mounted for movements between a trigger rest position and a trigger actuated position to actuate said actuating means, said trigger lever having a first abutment portion and a first limiting portion thereon; and a sensor mounted for movements relative to said mouth tool and adapted to be moved from a sensor rest position into a sensor operative position in response to said driving tool being placed upon a workpiece, said sensor suited for connection with an energization source for biasing said sensor into said sensor rest position wherein said sensor extends beyond said mouth tool, said sensor having a second abutment portion and a second limiting portion thereon whereby said first abutment portion and said second abutment portion are capable of engagement to prevent pivotal movements of said trigger lever from said trigger rest position to said trigger actuated position if said sensor is in said sensor rest position and said first limiting portion and said second limiting portion capable of engagement to prevent movement of said sensor to said sensor rest position if said trigger lever is in said trigger actuated position, said sensor further having a third abutment portion thereon and said trigger lever further includes a fourth abutment portion thereon, said third abutment portion and said fourth abutment portion co-operating to prevent movements of said sensor from said sensor rest position if said first abutment portion of said trigger lever has engaged said second abutment portion of said sensor due to a partial pivoting movement of said trigger lever.

2. The driving tool as claimed in claim 1 wherein said first abutment portion and said first limiting portion are both portions of a structure on said trigger lever.

3. The driving tool as claimed in claim 1 wherein said first abutment portion and said first limiting portion of said trigger lever is adapted to be pivoted into a recess of said sensor if said sensor is in said sensor operative position.

4. The driving tool as claimed in claim 1, wherein said first abutment portion is an upwardly extending nose portion of said trigger lever.

5. The driving tool as claimed in claim 1 wherein said sensor further includes a portion thereof having a longitudinally extending slit therein, and wherein said trigger lever further includes a pivot pin with said pivot pin extending through said longitudinally extending slit and wherein said third abutment portion is provided along said longitudinally extending slit.

6. The driving tool as claimed in claim 1 wherein said trigger lever further includes a spring means for biasing said trigger lever toward said trigger rest position.

7. The driving tool as claimed in claim 1 wherein said drive means further includes a piston suited for pneumatic pressurization by a pressure fluid source, said piston positioned so as to act upon said sensor if pressurized.

8. The driving tool as claimed in claim 1 wherein said energization source is suited for repeated actuation of said drive-in pusher thereby performing repetitive drive in operations if said trigger lever remains in said trigger actuation position.

9. A driving tool for fasteners, said driving tool comprising: actuating means suited for connection with an energization source for actuating a drive means, said drive means being capable of initiating a drive-in pusher so as to drive in fasteners from a mouth tool; a trigger lever pivotally mounted for movements between a trigger rest position and a trigger actuated position to actuate said actuating means, said trigger lever having a first abutment portion and a first limiting portion thereon; and a sensor mounted for movements relative to said mouth tool and adapted to be moved from a sensor rest position into a sensor operative position in response to said driving tool being placed upon a workpiece, said sensor suited for connection with an energization source for biasing said sensor into said sensor rest position wherein said sensor extends beyond said mouth tool, said sensor having a second abutment portion and a second limiting portion thereon whereby said first abutment portion and said second abutment portion are capable of engagement to prevent pivotal movements of said trigger lever from said trigger rest position to said trigger actuated position if said sensor is in said sensor rest position and said first limiting portion and said second limiting portion capable of engagement to prevent movement of said sensor to said sensor rest position if said trigger lever is in said trigger actuated position, said sensor further having a portion thereof having a longitudinally extending slit therein, and wherein said trigger lever further includes a pivot pin, with said pivot pin extending through said longitudinally extending slit.

* * * * *